US011920910B2

(12) United States Patent
Nielson et al.

(10) Patent No.: US 11,920,910 B2
(45) Date of Patent: Mar. 5, 2024

(54) COMPOSITIONS USABLE AS FLARE COMPOSITIONS, COUNTERMEASURE DEVICES CONTAINING THE FLARE COMPOSITIONS, AND RELATED METHODS

(71) Applicant: Northrop Grumman Systems Corporation, Falls Church, VA (US)

(72) Inventors: Daniel B. Nielson, Tremonton, UT (US); Curtis W. Fielding, Hyrum, UT (US)

(73) Assignee: Northrop Grumman Systems Corporation, Plymouth, MN (US)

( * ) Notice: Subject to any disclaimer, the term of this patent is extended or adjusted under 35 U.S.C. 154(b) by 0 days.

(21) Appl. No.: 14/190,417

(22) Filed: Feb. 26, 2014

(65) Prior Publication Data

US 2015/0259262 A1 Sep. 17, 2015

(51) Int. Cl.

| | |
|---|---|
| ***F42B 4/26*** | (2006.01) |
| ***C06B 33/06*** | (2006.01) |
| ***C06C 15/00*** | (2006.01) |
| ***F41J 2/02*** | (2006.01) |

(52) U.S. Cl.

CPC ..... *F42B 4/26* (2013.01); *C06B 33/06* (2013.01); *C06C 15/00* (2013.01); *F41J 2/02* (2013.01)

(58) Field of Classification Search

CPC ..... C06B 43/00; C06B 33/00; C06B 33/08; C06B 33/02; C06B 33/04; C06B 33/06; C06B 33/10; C06B 33/12; C06B 33/14; C06B 31/00; C06B 31/32; C06B 31/02; C06B 31/12; C06B 29/00; C06B 25/34; C06B 29/04; C06B 29/06; C06B 25/00; F42B 4/26

USPC .. 149/22, 37, 38, 41–43, 45, 47, 61, 62, 76, 149/85–87, 92; 102/364, 336

See application file for complete search history.

(56) References Cited

U.S. PATENT DOCUMENTS

| | | | | | |
|---|---|---|---|---|---|
| 3,000,174 | A * | 9/1961 | Vose | C06B 27/00 | 149/1 |
| 3,027,283 | A * | 3/1962 | Bice | C06B 45/10 | 149/19.3 |
| 3,044,912 | A * | 7/1962 | Proell | C06B 31/30 | 149/60 |
| 3,109,761 | A * | 11/1963 | Cobb | C06B 45/10 | 149/20 |
| 3,151,164 | A * | 9/1964 | Sammons | C06B 45/105 | 149/92 |

(Continued)

FOREIGN PATENT DOCUMENTS

| | | | | |
|---|---|---|---|---|
| DE | 102009052120 A1 * | 6/2010 | ..... | C06B 41/10 |
| EP | 1780494 A2 * | 5/2007 | ..... | C06B 45/00 |

(Continued)

OTHER PUBLICATIONS

Bayer MaterialScience Product Information for DESMODUR® N 100—Aliphatic Polyisocyanate, Jun. 2010, 2 pages.

(Continued)

*Primary Examiner* — Aileen B Felton
(74) *Attorney, Agent, or Firm* — TraskBritt

(57) ABSTRACT

A composition comprising boron, potassium ferricyanide, and at least one of an oxidizer, a nitramine, a binder, and an additive. Also disclosed are additional compositions, countermeasure devices including the composition, and a method of using the countermeasure device.

25 Claims, 2 Drawing Sheets

(56) References Cited

U.S. PATENT DOCUMENTS 3,151,165 A * 9/1964 Sammons ..... C06B 45/105 149/92
3,507,837 A * 4/1970 Hidinger, Jr. ..... C08C 19/36 149/19.5
3,793,100 A * 2/1974 Fronabarger ..... C06B 29/06 149/77
3,808,061 A * 4/1974 Pierce ..... C06B 23/04 149/20
3,865,035 A * 2/1975 Munson ..... C06B 45/10 102/364
3,977,923 A * 8/1976 Uelzmann ..... C06B 21/0025 149/19.1
4,131,499 A * 12/1978 Flanigan ..... C06B 45/10 149/19.3
5,470,408 A * 11/1995 Nielson ..... C06B 23/001 149/108.2
5,648,634 A * 7/1997 Avory ..... C06B 33/06 102/202.1
5,834,680 A 11/1998 Nielson et al.
5,912,430 A * 6/1999 Nielson ..... C06B 31/02 102/336
6,019,861 A * 2/2000 Canterberry ..... C06D 5/06 149/19.1
6,045,638 A * 4/2000 Lundstrom ..... C06D 5/06 149/36
6,123,789 A * 9/2000 Nielson ..... C06B 31/02 102/335
6,170,399 B1 * 1/2001 Nielson ..... C06B 21/0075 102/275.4
6,224,099 B1 * 5/2001 Nielson ..... C06B 21/0075 102/205
6,315,847 B1 * 11/2001 Lee ..... C06B 21/0066 149/108.6
6,425,966 B1 * 7/2002 Highsmith ..... C06B 45/105 149/19.1
6,427,599 B1 8/2002 Posson et al.
6,896,751 B2 * 5/2005 Posson ..... C06B 21/0025 149/109.6
7,278,356 B1 * 10/2007 Geisler ..... F42B 12/44 102/347
7,469,640 B2 12/2008 Nielson et al.
2001/0001970 A1 * 5/2001 Hagel ..... C06C 7/00 149/61
2005/0199323 A1 * 9/2005 Nielson ..... C06B 45/105 149/19.3
2007/0272112 A1 * 11/2007 Nielson ..... C06B 45/10 523/180
2008/0035007 A1 * 2/2008 Nielson ..... C06B 45/00 102/517
2008/0245252 A1 * 10/2008 Erickson ..... C06B 23/006 102/204
2009/0211484 A1 * 8/2009 Truitt ..... F42B 12/32 102/497
2013/0048163 A1 * 2/2013 Hafner ..... C06B 45/30 149/6

FOREIGN PATENT DOCUMENTS

NO 175304 * 6/1994
WO WO-0021907 A1 * 4/2000 ..... B60R 21/16

OTHER PUBLICATIONS

Holt, "Sampling of IR Expendables, RF Expendables and Dispensers," Technology Survey, The Journal of Electronic Defense, Aug. 2007, pp. 43-55.
Koch, "Pyrotechnic Countermeasures: V. Performance of Spectral Flare Compositions Based on Aromatic Compounds," Central European Journal of Energetic Materials, 2008, 5(3-4), pp. 55-63.
Kubota, Propellants and Explosives: Thermochemical Aspects of Combustion, Wiley-VCH Verlag Gmbh & Co. KGaA, (2002), 6 pages.
Sinditskii et al., Ammonium Nitrate: Combustion Mechanism and the Role of Additives, Propellants, Explosives, Pyrotechnics, vol. 30, No. 4, (2005), pp. 269-280.

* cited by examiner

COMPOSITIONS USABLE AS FLARE COMPOSITIONS, COUNTERMEASURE DEVICES CONTAINING THE FLARE COMPOSITIONS, AND RELATED METHODS

TECHNICAL FIELD

The present disclosure relates generally to compositions suitable for use in flares, and to methods of using the compositions. More specifically, the present disclosure relates to compositions that are formulated to produce an improved color ratio while maintaining a high infrared (IR) intensity in comparison to that of conventional two-color flare compositions.

BACKGROUND

Flares are pyrotechnic devices designed and configured to emit intense electromagnetic radiation at wavelengths in the visible region (i.e., visible light), the infrared (IR) region (i.e., heat), or both, of the electromagnetic radiation spectrum without exploding or producing an explosion. Conventionally, flares have been used for signaling, illumination, and defensive countermeasures in civilian and military applications. Decoy flares are one type of flare used in military applications for defensive countermeasures. When an aircraft detects that a heat-seeking missile is in pursuit, the decoy flare is used as protection against the heat-seeking missile. The heat-seeking missile is designed to track and follow the target aircraft by detecting the IR emissions of engines of the target aircraft. The decoy flare is launched from the target aircraft and ignited to produce IR radiation that mimics the IR emissions of the engines of the target aircraft. The IR emissions of the decoy flare are produced by combustion of a flare composition that is conventionally referred to as the "grain" of the decoy flare. The IR emissions of the combusting flare composition are intended to confuse the heat-seeking missile, causing the heat-seeking missile to turn away from the target aircraft and toward the decoy flare.

Conventional flare compositions in a decoy flare include magnesium, TEFLON®, and VITON® (MTV), or are red-phosphorus based. While these conventional flare compositions produce sufficient intensity, the electromagnetic radiation does not correspond to the IR emissions of the target aircraft. In addition, modern heat-seeking missiles are capable of distinguishing between short wavelength IR emissions, such as gray-body materials having higher temperatures and/or heated water vapor, and long wavelength IR emissions, which are produced by aircraft components, such as the aircraft engines. These modern heat-seeking missiles include sensor systems configured to compare an IR output color ratio of the midband IR/short band IR of the target aircraft. Two-color flare compositions have been developed to produce IR emissions having higher color ratios, such as color ratios more closely matched to those of a target aircraft. However, conventional two-color flare compositions have various drawbacks, such as deficient emission characteristics including, but not limited to, deficient IR intensity and an insufficient color ratio. In addition to achieving the desired IR intensity and color ratio, the decoy flare including the two-color flare composition must be configured to provide a consistent ejection velocity when deployed, produce a consistent rapid spectral rise time to the desired IR spectral output, and exhibit a reduced incidence of failure. However, achieving these desired properties is often a tradeoff.

It would be desirable to produce a two-color flare composition exhibiting an improved color ratio while maintaining a high IR intensity during use and operation of a decoy flare containing the two-color flare composition.

BRIEF SUMMARY

Disclosed is an embodiment of a composition comprising boron, potassium ferricyanide, and at least one of an oxidizer, a nitramine, a binder, and an additive.

Also disclosed is another embodiment of a composition comprising potassium ferricyanide, potassium perchlorate, and calcium silicide.

Also disclosed is yet another embodiment of a composition comprising calcium silicide, cyclo-1,3,5-trimethylene-2,4,6-trinitramine, and potassium perchlorate.

Also disclosed is another embodiment of a composition comprising boron, calcium silicide, and cyclo-1,3,5-trimethylene-2,4,6-trinitramine.

Yet another embodiment of a composition is disclosed, the composition comprising boron, potassium perchlorate, and a carboxy terminated triethyleneglycol succinate.

Yet another embodiment of a composition is disclosed, the composition comprising boron, potassium perchlorate, glycidyl azide polymer, and 1,8-bis(dimethyl-amino)naphthalene.

Also disclosed in another embodiment of a composition comprising boron, cyclo-1,3,5-trimethylene-2,4,6-trinitramine, and at least one of iron oxide and 1,8-bis(dimethyl-amino)naphthalene.

Also disclosed in another embodiment of a composition comprising potassium ferricyanide, potassium perchlorate, and cyclo-1,3,5-trimethylene-2,4,6-trinitramine.

A countermeasure device is disclosed, the countermeasure device comprising a casing and a flare composition contained in the casing. The flare composition comprises boron, potassium ferricyanide, and at least one of an oxidizer, a nitramine, a binder, and an additive.

A method of using a countermeasure device is disclosed, the method comprising deploying a countermeasure device against a heat-seeking device, the countermeasure device comprising a casing and a flare composition contained in the casing. The flare composition comprises boron, potassium ferricyanide, and at least one of an oxidizer, a nitramine, a binder, and an additive. The flare composition is ignited.

DETAILED DESCRIPTION

Figure 1:
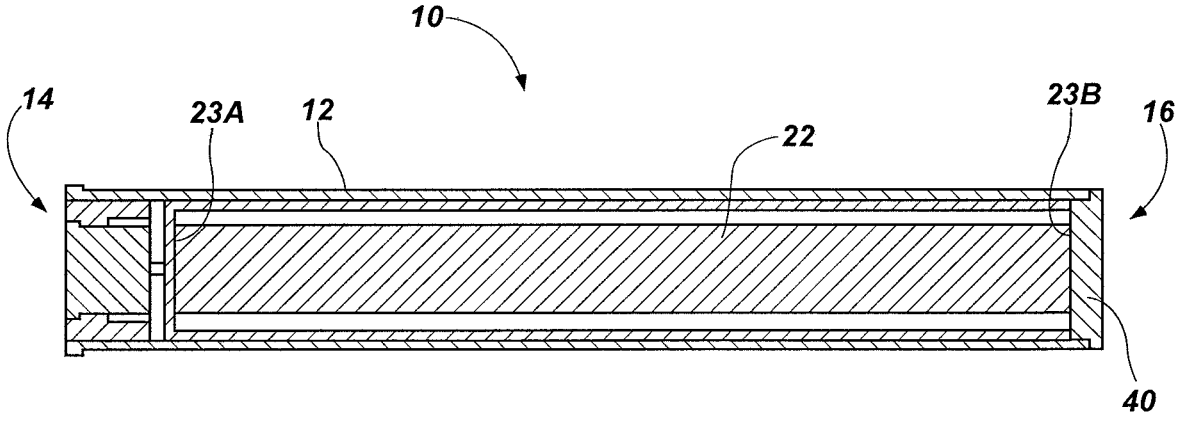
FIG. 1 is a cross-sectional view of a decoy flare including a grain formed from a composition according to embodiments of the present disclosure.

A composition for use as a flare composition is disclosed, as are flares including the flare composition and methods of using the flare composition. The composition is used as a two-color flare composition of a countermeasure device, which may be configured as a decoy flare. As used herein, the term "decoy flare" means and includes a countermeasure decoy having an infrared (IR) output designed to confuse, decoy, or otherwise defeat a heat-seeking missile. The compositions of embodiments of the present disclosure, when ignited, may exhibit improved effectiveness at defeating heat-seeking missiles compared to conventional two-color flare compositions. In use and operation, the decoy flare containing the flare composition according to embodiments of the present disclosure may exhibit a high color ratio while maintaining a high IR intensity. As used herein, the term "color ratio" means and includes the ratio of midband wavelength IR output (ML) to short wavelength IR output (SW). The flare composition according to embodiments of the present disclosure may also exhibit cleaner combustion, a reduced variance in rise time (i.e., a fast rise time), and a reduced shorthand IR intensity compared to a decoy flare including a conventional two-color composition.

As used herein, the terms "comprising," "including," "containing," "characterized by," and grammatical equivalents thereof are inclusive or open-ended terms that do not exclude additional, unrecited elements or method acts, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure and such term is used in preference to the more restrictive term "is" so as to avoid any implication that other, compatible materials, structures, features and methods usable in combination therewith should or must be excluded.

The composition may include at least one of an oxidizer, a fuel, a binder, and an additive. The composition may comprise, consist essentially of, or consist of the disclosed ingredients. In some embodiments, the oxidizer is potassium perchlorate (KP), strontium nitrate ($Sr(NO_3)_2$), or a combination thereof. The amount of oxidizer present in a particular composition may be selected based on the desired emission performance and on the other composition ingredients. The oxidizer may be present in the composition at from about 5% by weight (wt %) to about 70 wt %, such as from about 6.5 wt % to about 68 wt % or from about 30 wt % to about 60 wt %. The oxidizer may be present as a single particle size, such as a particle size ranging from about 3 μm to about 80 μm, such as from about 5 μm to about 60 μm. To help with processing, the oxidizer may also be present in a variety of particle sizes, such as a bimodal or trimodal size distribution. By way of example only, the oxidizer may be present in a combination of 5 μm and 40 μm particle sizes, a combination of 5 μm and 60 μm particle sizes, or a combination of 40 μm and 60 μm particle sizes. While examples herein describe the oxidizer as potassium perchlorate or strontium nitrate, other oxidizers may be used, such as other nitrates, a perchlorate, a peroxide, or a combination thereof. Other oxidizers that may be used include, but are not limited to, ammonium nitrate (AN), ammonium perchlorate (AP), sodium nitrate (SN), potassium chlorate ($KClO_3$), potassium iodate ($KIO_3$), potassium nitrate (KN), lithium nitrate, rubidium nitrate, cesium nitrate, lithium perchlorate, sodium perchlorate, rubidium perchlorate, cesium perchlorate, magnesium perchlorate, calcium perchlorate, strontium perchlorate, barium perchlorate, barium peroxide, strontium peroxide, or a combination thereof.

The fuel may be boron, silicon, a metal, calcium silicide ($CaSi_2$), a nitramine, nitrocellulose containing single or double based gun propellants, ball powder (nitrocellulose with ball-shaped particles), or a combination thereof. The metal may include, but is not limited to, hafnium, tantalum, nickel, zinc, tin, palladium, bismuth, iron, copper, phosphorous, aluminum, tungsten, zirconium, magnesium, boron, titanium, magnalium, or a combination thereof. The nitramine may include, but is not limited to, trinitrotoluene (TNT), cyclo-1,3,5-trimethylene-2,4,6-trinitramine (RDX), cyclotetramethylene tetranitramine (HMX), hexanitrohexaazaisowurtzitane (CL-20), trimethylolethane trinitrate (TMETN), diethylene glycol dinitrate (DEGDN), and triethylene glycol dinitrate (TEGDN), 4,10-dinitro-2,6,8,12-tetraoxa-4,10-diazatetracyclo-[$5.5.0.0^{5,9}0.0^{3,11}$]-dodecane (TEX), ammonium dinitramide (ADN), 1,3,3-trinitroazetine (TNAZ), 2,4,6-trinitro-1,3,5-benzenetriamine (TATB), dinitrotoluene (DNT), or combinations thereof. In some embodiments, the fuel is boron, aluminum, calcium silicide, a combination of boron and calcium silicide, a combination of boron and RDX, a combination of aluminum and RDX, or ball powder. The fuel may be present in the composition at from about 1 wt % to about 25 wt %, such as from about 1 wt % to about 20 wt %, such as from about 2.5 wt % to about 17.5 wt %. However, a higher amount of the fuel in the composition may provide an increased IR intensity when the flare composition is combusted and may reduce the color ratio depending on the fuel to oxidizer level in the composition.

The composition may include the oxidizer and fuel in a fuel:oxidizer, ratio of less than about 2.5, such as between about 1.4 and about 2.3. However, the fuel:oxidizer ratio may vary depending on the fuel and oxidizer. A fuel:oxidizer ratio may be selected based on the desired emission performance of the composition.

The binder may be an energetic binder or non-energetic binder conventionally used in the field of pyrotechnics. The energetic binder may include, but is not limited to, poly(3-azidomethyl-3-methyloxetane) (poly-AMMO), poly(bis(3,3-azidomethyl)oxetane) (poly-BAMO), poly(3-nitratomethyl-3-methyloxetane) (poly NIMMO), a random copolymer of poly-(BAMO) and poly-AMMO, glycidyl azide polymer (GAP), polyglycidyl nitrate (PGN), poly (nitraminomethyl-methyloxetane) (poly-NAMMO), copoly-BAMMO/NAMMO, copoly-BAMMO/AMMO, nitrocellulose, nitroglycerine, other nitrate esters, or a combinations thereof. The non-energetic binder may include, but is not limited to, a triethyleneglycol succinate, gum arabic, gum tragacanth, gum xanthan, gum turpentine, a polyester, a polyether, a polyurethane, a polystyrene, a polyvinyl alcohol, a silicone, a styrene-butadiene, an epoxy resin, an isobutylene rubber, or a combination thereof. In some embodiments, the binder is GAP. In other embodiments, the binder is a carboxy terminated triethyleneglycol succinate, such as Witco 1780, which is commercially available from Witco Chemical Corp. The binder may be used with a curative, as described below.

The additive may be a burn rate modifier, a catalyst, a curative, an amine base, an iron oxide ($Fe_2O_3$), or a combination thereof. The burn rate modifier may be a potassium salt, such as potassium ferricyanide (KFC), another alkali metal ferricyanide, another potassium salt, or a combination thereof. Potassium ferricyanide has a chemical formula of $K_3[Fe(CN)_6]$. The KFC may have a particle size of from about 5 μm to about 10 μm. The burn rate modifier may be present in the composition at from about 0.1 wt % to about 30 wt %, such as from about 1 wt % to about 8 wt % or from about 1 wt % to about 4 wt %. In some embodiments, KFC may be used as a fuel to replace some or all of the boron.

The catalyst, if present, may include, but is not limited to, dibutyltin dilaurate (DBTDL), triphenylbismuth, magnesium carbonate, or dibutyltin diacetate. The catalyst may be selected based on other ingredients in the composition, such as the binder. If present, the catalyst may account for from about 0.1% wt % to about 1 wt % of the composition.

The curative, if present, may include, but is not limited to, an isocyanate or an epoxide, and may be selected based on other ingredients in the composition, such as the binder. If present, the curative may account for from about 0.1% wt % to about 5 wt % of the composition. By way of example only, the curative may be an aliphatic polyisocyanate resin based on hexamethylene diisocyanate (HDI), such as that sold under the DESMODUR® N 100 tradename by Bayer MaterialScience (Pittsburgh, PA), or a trifunctional epoxy resin curative (ERL) that reacts with the carboxy functional groups of the carboxy terminated triethyleneglycol succinate. In some embodiments, the binder is GAP and curative is an aliphatic polyisocyanate resin based on HDI. Without being bound by any particular theory, the combination of GAP and the aliphatic polyisocyanate resin based on HDI is fast burning when the composition is combusted.

The amine base (e.g., an acid scavenger) may be 1,8-bis (dimethylamino)-naphthalene, which is commercially available from Sigma-Aldrich Corp. (St. Louis, MO) under the PROTON-SPONGE® tradename. The amine base may be present in the composition at from about 0.1% wt % to about 1 wt %, such as from about 0.2 wt % to about 0.8 wt %.

By way of example only, the iron oxide may be a high surface area iron oxide, such as that sold under the SICOTRANS™ tradename, which is commercially available from BASF Corp. (Florham Park, NJ). The iron oxide exhibits a specific surface area of greater than or equal to about 90 $m^2/g$, such as greater than or equal to about 93 $m^2/g$, as measured by the Brunauer-Emmett-Teller (BET) technique. The iron oxide may be present in the composition at from about 0.1% wt % to about 30 wt %, such as from about 0.2 wt % to about 1 wt %. In some embodiments, the iron oxide may be used with a nonenergetic binder, such as a triethyleneglycol succinate.

The composition may optionally include other ingredients, such as colorants, processing aids, bonding agents, stabilizers, or ballistic enhancers, in minor amounts, depending on the desired properties of the composition.

In one embodiment, the composition includes boron as the fuel and KFC as the burn rate modifier. By including the KFC in the composition, a lower amount of boron may be used while still maintaining the IR intensity of the composition when combusted. Without being bound to any theory, the KFC is believed to catalyze the burn rate and rise rate of the composition, enabling improved ignition of boron in the flare composition. The presence of the KFC may also provide a faster rise rate and a slower burn rate to the flare composition, as well as providing cleaner combustion and a high color ratio. The rise rate is the amount of time elapsed from deployment of the decoy flare from the aircraft to when the combusting flare composition exhibits full spectral intensity.

The flare composition may be produced by combining the ingredients of the composition. The flare composition may have a lower viscosity or a similar viscosity to that of conventional two-color composition, such as less than about 10 kP at 100° F. (about 37.8° C.). A grain may be produced by casting, pressing, molding, or extruding the flare composition. Such processes are known in the art and, therefore, are not described in detail herein. In some embodiments, the flare composition is produced by combining the ingredients of the composition by a mixed cast process that is solventless. By way of example only, the ingredients may be combined to form a slurry, and articles fabricated from the slurry, such as by casting the slurry into a casing or mold, and curing the slurry at a moderately elevated temperature to form the grain. Once cured, the grain can be removed from the casing or mold. The grain may have a relatively high hardness, such as a Shore A hardness of greater than about 65, such as greater than about 80.

Embodiments of the compositions of the present disclosure may be used as a drop-in replacement for the grain (i.e., flare composition, payload) of a conventional decoy flare, such as a decoy flare having a form factor of 1×1×8 inch, 1×2×8 inch, 2×2.5 inch, 36 mm round, or kinematic in the same form factors as previously listed. Examples of such decoy flares are known in the art and may be referred to as M212, MJU-8A/B, MJU-23B, MJU-62B, or MJU-59 decoy flares. Thus, the decoy flares may be characterized as a "modified" M212, MJU-62B, MJU-10, MJU-59, or MJU-67 flare in that the grain of a conventional decoy flare is replaced with a composition according to an embodiment of the present disclosure. When used in a countermeasure device that is deployed, the compositions of the present disclosure may exhibit a higher color ratio and a faster rise time compared to a conventional flare containing a conventional two-color flare composition.

FIG. 1 illustrates a flare 10, such as a decoy flare, that includes grain 22 (i.e., flare composition, payload) formed from a composition according to an embodiment of the present disclosure. The grain 22 is contained in a casing 12 of the flare 10. The casing 12 may have a first end 14, i.e., the aft end, from which an aft end 23A of the grain 22 is ignited, and a second end 16, i.e., the forward end opposite from the aft end, from which the grain 22 is ejected upon ignition. For simplicity, an igniter for igniting the grain 22 is not shown in FIG. 1. The flare 10 also includes an end cap 40 that is attached to a forward end 23B of the grain 22. When the flare 10 is deployed against a heat-seeking missile, the flare 10 may exhibit improved effectiveness at defeating the heat-seeking missile compared to a conventional flare containing a conventional two-color flare composition.

The following examples serve to explain embodiments of the present disclosure in more detail. These examples are not to be construed as being exhaustive, exclusive or otherwise limiting as to the scope of this disclosure.

EXAMPLES

Example 1

Formulations of Compositions A-BR

Various embodiments of compositions according to the present disclosure include the ingredients shown in Tables 1-4. Each of the ingredients is commercially available, and may be purchased from commercial sources including, but not limited to, Sigma-Aldrich Corp., BASF Corp., Bayer MaterialScience, etc.

TABLE 1

Formulations of Compositions A-T.

| Ingredient (wt %) | Composition A | B | C | D | E | F | G | H | I | J | K |
|---|---|---|---|---|---|---|---|---|---|---|---|
| KP 60 μm | 25 | 23.75 | | 38 | | | | 25 | 25 | 25 | 27.25 |
| KP 40 μm | 25 | 23.75 | 47.5 | | 38 | 38 | 38 | 25 | 25 | 25 | 27.25 |
| KP 5 μm | | | | 9.5 | 9.5 | 10.1 | 10.7 | | | | |
| $Sr(NO_3)_2$ | | | | | | | | | | | |
| Boron | 2.5 | 5 | 5 | 5 | 5 | 4.38 | 3.75 | 0 | 0 | 0 | 0 |
| Calcium silicide | 0 | 0 | 0 | 0 | | | | 2.5 | 0 | 0 | 10 |
| RDX | 17.5 | 17.5 | 17.5 | 17.5 | 17.5 | 17.5 | 17.5 | 17.5 | 17.5 | 20 | 7 |
| Aluminum (H5) | | | | | | | | | 2.5 | | |
| GAP/N-100[1] | 27.5 | 27.5 | 27.5 | 27.5 | 27.5 | 27.5 | 27.5 | 27.5 | 27.5 | 27.5 | 27.5 |
| Witco/ERL[2] | | | | | | | | | | | |
| Silicone | | | | | | | | | | | |
| KFC | 2.5 | 2.5 | 2.5 | 2.5 | 2.5 | 2.5 | 2.5 | 2.5 | 2.5 | 2.5 | 1 |
| 1,8-bis(dimethylamino)-naphthalene[3] | 0.2 | 0.2 | 0.2 | 0.2 | 0.2 | 0.2 | 0.2 | | | | |
| High surface area iron oxide[4] | | | | | | | | | | | 0 |
| Total | 100.2 | 100.2 | 100.2 | 100.2 | 100.2 | 100.2 | 100.2 | 100.0 | 100.0 | 100.0 | 100.0 |

| Ingredient (wt %) | Composition L | M | N | O | P | Q | R | S | T |
|---|---|---|---|---|---|---|---|---|---|
| KP 60 μm | 27.25 | 23.25 | 22.75 | 22.5 | | 36 | 24.8 | | |
| KP 40 μm | 27.25 | 23.25 | 22.75 | 22.5 | 45 | | 24.8 | 49.6 | 49.6 |
| KP 5 μm | | | | | | 9 | | | |
| $Sr(NO_3)_2$ | | | | | | | | | |
| Boron | 0 | 0 | 0 | 1.5 | 1.5 | 1.5 | 1.1 | 1.1 | 1.1 |
| Calcium silicide | 10 | 15 | 15 | 15 | 15 | 15 | 13.9 | 13.9 | 13.9 |
| RDX | 7 | 10 | 10 | 10 | 10 | 10 | 5.7 | 5.7 | 5.7 |
| Aluminum (H5) | | | | | | | | | |
| GAP/N-100[1] | 27.5 | 27.5 | 27.5 | 27.5 | 27.5 | 27.5 | 27.5 | 27.5 | 27.5 |
| Witco/ERL[2] | | | | | | | | | |
| Silicone | | | | | | | | | |
| KFC | 0 | 0 | 2 | 1 | 1 | 1 | 2.2 | 2.2 | 2.2 |
| 1,8-bis(dimethylamino)-naphthalene[3] | | | | 0.2 | 0.2 | 0.2 | 0.2 | 0.2 | 0.2 |
| High surface area iron oxide[4] | 1 | 1 | 0 | | | | | | |
| Total | 100.0 | 100.0 | 100.0 | 100.2 | 100.2 | 100.2 | 100.2 | 100.2 | |

[1]N-100 is commercially available from Bayer MaterialScience under the DESMODUR ® N 100 tradename

[2]a carboxy terminated triethyleneglycol succinate (Witco 1780) and a trifunctional epoxy resin curative (ERL) that reacts with the carboxy functional groups of the carboxy terminated triethyleneglycol succinate

[3]commercially available from Sigma-Aldrich Corp. under the PROTON-SPONGE ® tradename

[4]commercially available from BASF Corp. under the SICOTRANS ™ tradename

TABLE 2

Formulations of Compositions U-AM.

| Ingredient (wt %) | Composition U | V | W | X | Y | Z | AA | AB | AC | AD |
|---|---|---|---|---|---|---|---|---|---|---|
| KP 60 μm | 19.75 | 21.75 | 20.75 | 24.3 | | 38.90 | 17.75 | 28 | 25.5 | 19.75 |
| KP 40 μm | 19.75 | 21.75 | 20.75 | 24.3 | 48.60 | | 17.75 | 28 | 25.5 | 19.75 |
| KP 5 μm | | | | | | 9.700 | | | | |
| $Sr(NO_3)_2$ | | | | | | | | | | |
| Boron | 0 | 0 | 0 | 1.2 | 1.2 | 1.2 | 0 | 2.5 | 5 | 0 |
| Calcium silicide | 20 | 15 | 15 | 13.9 | 13.9 | 13.9 | 20 | 0 | 0 | 17.5 |
| RDX | 10 | 13 | 13 | 6.3 | 6.3 | 6.3 | 13 | 13 | 13 | 13 |
| Aluminum (H5) | | | | | | | | | | |
| GAP/N-100[1] | 27.5 | 27.5 | 27.5 | 27.5 | 27.5 | 27.5 | 27.5 | 27.5 | 27.5 | 27.5 |
| Witco/ERL[2] | | | | | | | | | | |
| Silicone | | | | | | | | | | |
| KFC | 2 | 0 | 3 | 2.5 | 2.5 | 2.5 | 3 | 0 | 2.5 | 1.5 |
| 1,8-bis(dimethylamino)-naphthalene[3] | | | | 0.2 | 0.2 | 0.2 | | | | 0.2 |

TABLE 2-continued

Formulations of Compositions U-AM.

| | | | | | | | | | | |
|---|---|---|---|---|---|---|---|---|---|---|
| High surface area iron oxide[4] | 1 | 1 | 0 | | | | 1 | 1 | 1 | 1 |
| Total | 100.0 | 100.0 | 100.0 | 100.2 | 100.2 | 100.2 | 100.0 | 100.0 | 100.0 | 100.2 |

| | Composition | | | | | | | | |
|---|---|---|---|---|---|---|---|---|---|
| Ingredient (wt %) | AE | AF | AG | AH | AI | AJ | AK | AL | AM |
| KP 60 μm | 21 | 24.625 | 25.875 | 24.625 | 25.875 | 25.725 | 54 | 29.25 | 30.5 |
| KP 40 μm | 21 | 24.625 | 25.875 | 24.625 | 25.875 | 25.725 | | 29.25 | 30.5 |
| KP 5 μm | | | | | | | | | |
| $Sr(NO_3)_2$ | | | | | | | | | |
| Boron | 0 | 1.25 | 1.25 | 2.5 | 2.5 | 3 | 3 | 6 | 6 |
| Calcium silicide | 17.5 | 13.75 | 13.75 | 13.75 | 13.75 | 12 | 12 | 0 | 0 |
| RDX | 13 | 6.5 | 6.5 | 6.5 | 6.5 | 6 | 6 | 5 | 6 |
| Aluminum (H5) | | | | | | | | | |
| GAP/N-100[1] | 25 | 27.5 | 25 | 27.5 | 25 | 27.5 | 25 | 27.5 | 25 |
| Witco/ERL[2] | | | | | | | | | |
| Silicone | | | | | | | | | |
| KFC | 1.5 | 1.25 | 1.25 | 0 | 0 | 0 | 0 | 2.5 | 2 |
| 1,8-bis(dimethylamino)-naphthalene[3] | 0.2 | 0.2 | 0.2 | 0.2 | 0.2 | 0.2 | 0.2 | 0.2 | 0.2 |
| High surface area iron oxide[4] | 1 | 0.5 | 0.5 | 0.5 | 0.5 | 0 | 0 | 0.5 | 0 |
| Total | 100.2 | 100.2 | 100.2 | 100.2 | 100.2 | 100.2 | 100.2 | 100.2 | 100.2 |

[1]N-100 is commercially available from Bayer MaterialScience under the DESMODUR ® N 100 tradename

[2]a carboxy terminated triethyleneglycol succinate (Witco 1780) and a trifunctional epoxy resin curative (ERL) that reacts with the carboxy functional groups of the carboxy terminated triethyleneglycol succinate

[3]commercially available from Sigma-Aldrich Corp. under the PROTON-SPONGE ® tradename

[4]commercially available from BASF Corp. under the SICOTRANS ™ tradename

TABLE 3

Formulations of Compositions AN-BG.

| | Composition | | | | | | | | | | |
|---|---|---|---|---|---|---|---|---|---|---|---|
| Ingredient (wt %) | AN | AO | AP | AQ | AR | AS | AT | AU | AV | AW | AX |
| KP 60 μm | 27.5 | 27.5 | 28.25 | 27 | 24.5 | 27 | | 43.5 | 31.25 | 29.25 | 31.25 |
| KP 40 μm | 27.5 | 27.5 | 28.25 | 27 | 24.5 | 27 | 54 | | 31.25 | 29.25 | |
| KP 5 μm | | | | | | | | 10.5 | | | |
| $Sr(NO_3)_2$ | | | | | | | | | | | 31.25 |
| Boron | 2.5 | 0 | 0 | 0 | 0 | 1 | 1 | 1 | 6 | 6 | 6 |
| Calcium silicide | 12.5 | 15 | 15 | 15 | 20 | 15 | 15 | 15 | 0 | 0 | 0 |
| RDX | 0 | 0 | 0 | 0 | 0 | 0 | 0 | 0 | 0 | 0 | 0 |
| Aluminum (H5) | | | | | | | | | | | |
| GAP/N-100[1] | 27.5 | 27.5 | 27.5 | 27.5 | 27.5 | 27.5 | 27.5 | 27.5 | 27.5 | 27.5 | 27.5 |
| Witco/ERL[2] | | | | | | | | | | | |
| Magnesium carbonate | | | | | | | | | | | |
| KFC | 2.5 | 2.5 | 2.5 | 2.5 | 2.5 | 2.5 | 2.5 | 2.5 | 4 | 8 | 4 |
| 1,8-bis(dimethylamino)-naphthalene[3] | | | | | | 0.2 | 0.2 | 0.2 | | | |
| High surface area iron oxide[4] | | | 1 | 1 | 1 | | | | | | |
| Total | 100.0 | 100.0 | 102.5 | 100.0 | 100.0 | 100.2 | 100.2 | 100.2 | 100.0 | 100.0 | 100.0 |

| | Composition | | | | | | | | |
|---|---|---|---|---|---|---|---|---|---|
| Ingredient (wt %) | AY | AZ | BA | BB | BC | BD | BE | BF | BG |
| KP 60 μm | 32.5 | 31.34 | | | | 32 | | | |
| KP 40 μm | 32.5 | 31.34 | | | | 32 | 43.1 | 42 | 45.2 |
| KP 5 μm | | | 6.5 | 13 | 19.2 | | 10.8 | 10.5 | 11.3 |
| $Sr(NO_3)_2$ | | | | | | | | | |
| Boron | 11 | 11 | 11 | 11 | 11 | 11 | 7.3 | 6 | 6 |
| Calcium silicide | | | | | | | | | |
| RDX | | | | | | | 14.3 | 17 | 13 |
| Aluminum (H5) | | | | | | | | | |
| GAP/N-100[1] | | | | | | | | | |

TABLE 3-continued

| Formulations of Compositions AN-BG. | | | | | | | | | |
|---|---|---|---|---|---|---|---|---|---|
| Witco/ERL[2] | 24 | 26 | 24 | 24 | 24 | 24 | 25 | 25 | 25 |
| Magnesium carbonate | 0.12 | 0.12 | 0.12 | 0.12 | 0.12 | 0.12 | 0.12 | 0.12 | 0.12 |
| KFC | | | | | | | | | |
| 1,8-bis(dimethylamino)-naphthalene[3] | | | | | | | | | |
| High surface area iron oxide[4] | | 0.2 | 0.2 | 0.2 | 0.2 | 1 | 0.25 | 0.25 | 0.25 |
| Total | 100.1 | 100.0 | 41.8 | 48.3 | 54.5 | 100.1 | 100.9 | 100.9 | 100.9 |

[1]N-100 is commercially available from Bayer MaterialScience under the DESMODUR ® N 100 tradename
[2]a carboxy terminated triethyleneglycol succinate (Witco 1780) and a trifunctional epoxy resin curative (ERL) that reacts with the carboxy functional groups of the carboxy terminated triethyleneglycol succinate
[3]commercially available from Sigma-Aldrich Corp. under the PROTON-SPONGE ® tradename
[4]commercially available from BASF Corp. under the SICOTRANS ™ tradename

TABLE 4

| Formulations of Compositions BH-BR. | | | | | | | | | | | |
|---|---|---|---|---|---|---|---|---|---|---|---|
| | Composition | | | | | | | | | | |
| Ingredient (wt %) | BH | BI | BJ | BK | BL | BM | BN | BO | BP | BQ | BR |
| KP 100 μm | | | | | | | | | 28.63 | 19.63 | 12.13 |
| KP 60 μm | | | | | 32.25 | 34 | 34 | 33.5 | | | |
| KP 40 μm | 42 | 43.6 | 43.6 | 42 | 32.25 | 34 | 34 | 33.5 | | | |
| KP 20 μm | | | | | | | | | 28.63 | 19.63 | 12.13 |
| KP 5 μm | 10.5 | 10.9 | 10.9 | 10.5 | | | | | | | |
| $Sr(NO_3)_2$ | | | | | | | | | | | |
| Boron | 10 | 6 | 8 | 8 | 8 | 7 | 6 | 5 | | | |
| Ball powder | | | | | | | | | 20 | 35 | 50 |
| Calcium silicide | | | | | | | | | | | |
| RDX | 13 | 15 | 13 | 15 | | | | | | | |
| Aluminum (H5) | | | | | | | | | | | |
| GAP/N-100[1] | | | | | 27.5 | 25 | 26 | 27 | | | |
| Witco/ERL[2] | 25 | 25 | 25 | 25 | | | | | | | |
| Silicone | | | | | | | | | 22 | 22 | 22 |
| Magnesium carbonate | 0.12 | 0.12 | 0.12 | 0.12 | | | | | | | |
| KFC | | | | | | | 1 | 1 | | 3 | 3 |
| 1,8-bis(dimethylamino)-naphthalene[3] | | | | | 0.2 | 0.2 | 0.2 | 0.2 | | | |
| High surface area iron oxide[4] | 0.25 | 0.25 | 0.25 | 0.25 | | | | | 0.75 | 0.75 | 0.75 |
| Total | 100.9 | 100.9 | 100.9 | 100.9 | 100.2 | 100.2 | 101.2 | 100.2 | 100 | 100 | 100 |

[1]N-100 is commercially available from Bayer MaterialScience under the DESMODUR ® N 100 tradename
[2]a carboxy terminated triethyleneglycol succinate (Witco 1780) and a trifunctional epoxy resin curative (ERL) that reacts with the carboxy functional groups of the carboxy terminated triethyleneglycol succinate
[3]commercially available from Sigma-Aldrich Corp. under the PROTON-SPONGE ® tradename
[4]commercially available from BASF Corp. under the SICOTRANS ™ tradename The compositions are formulated by combining the listed ingredients according to conventional techniques for processing pyrotechnic compositions.

Example 2

Performance Data

The performance of decoy flares including a composition (labeled "Inventive Composition" in Table 5) similar to Composition BO was tested in 1×1×8 inch and 1×2×8 inch form factors at T-2 wind stream under 120 and 240 knot blow-down. The Inventive Composition differed from Composition BO by less than 1% in the amount of boron and GAP present. The performance testing was conducted by conventional techniques, which are not described in detail herein. As known in the art, methodology for determining a color ratio is described in the specifications for the M212 flare. The decoy flares including the Inventive Composition had an improved color ratio and spectral intensity when compared to the conventional M212 flare. The decoy flares including the Inventive Composition also had an equivalent rise time.

TABLE 5

| Performance Testing Results | |
|---|---|
| Performance Metric | Difference of Inventive Composition Compared to Conventional M212 Flare |
| Color Ratio | 210% |
| Intensity | 75% |
| Rise Time | Equivalent |
| Rise Time Coefficient of Variance | 37% |

Figure 2:
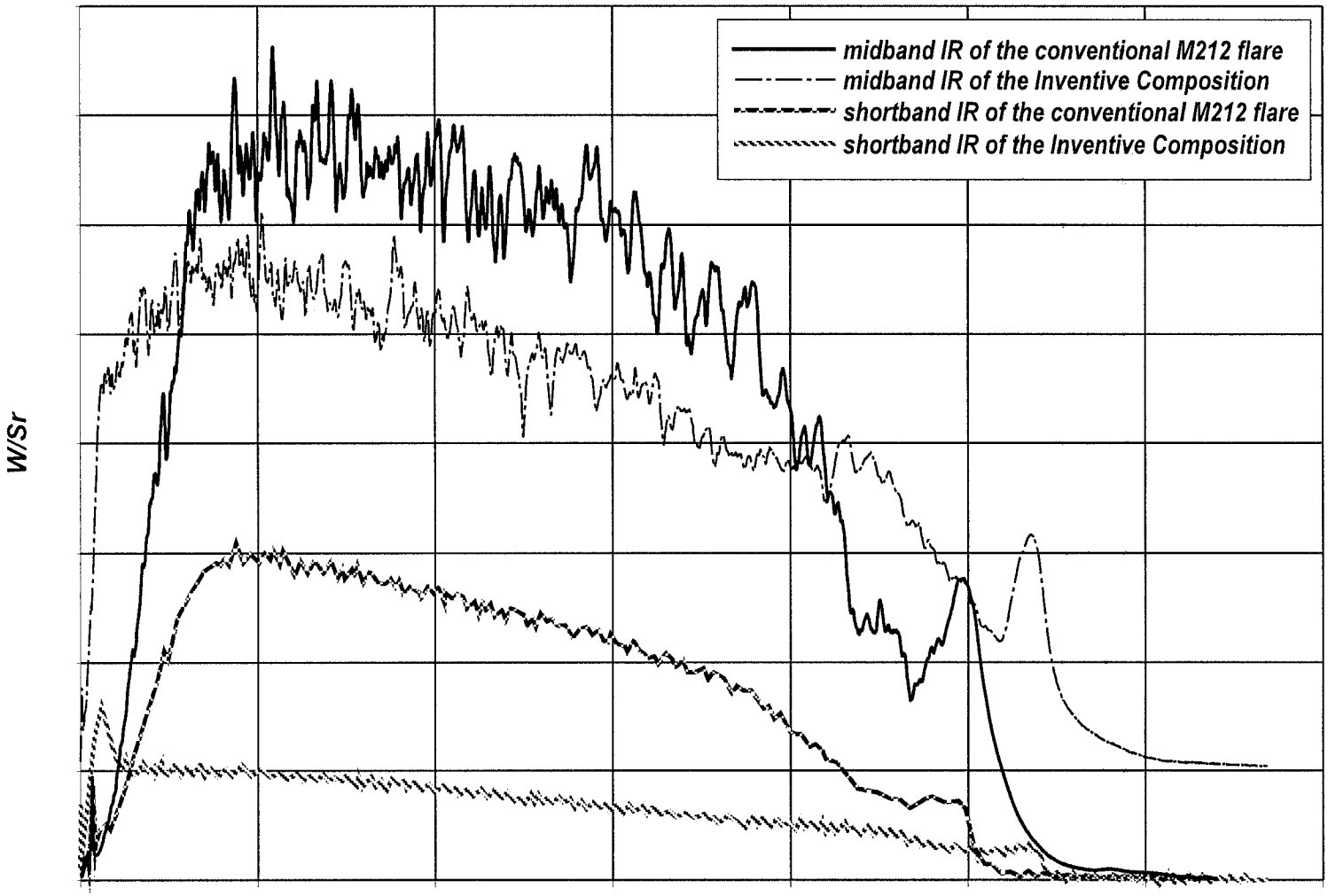
FIG. 2 is a graph showing radiant intensity in W/Sr (y-axis) as a function of time (x-axis) for a composition according to an embodiment of the present disclosure compared to that of a conventional decoy flare.

The intensity of a decoy flare including the Inventive Composition was compared to that of a conventional M212 flare. FIG. 2 shows the relative radiant intensity in W/Sr (y-axis) as a function of time (x-axis) for the Inventive Composition compared to that of a conventional M212 flare. The intensities of midband and shortband IR emissions were measured by conventional techniques. The data representatively reflects deployment of the decoy flares from an aircraft at an air (wind) speed of about 120 knots. As shown in FIG. 2, the decoy flare including the Inventive Composition, when deployed and combusted, exhibited a faster rise rate and an acceptable intensity relative to that of the conventional M212 flare. The decoy flare including the Inventive Composition also achieved a higher color ratio compared to that of the conventional M212 flare.

While the disclosure may be susceptible to various modifications and alternative specific embodiments have been shown by way of example in the drawings and have been described in detail herein. However, it should be understood that the invention is not intended to be limited to the particular forms disclosed. Rather, the invention encompasses all modifications, equivalents, and alternatives falling within the scope of the following appended claims and their legal equivalents.

What is claimed is:

1. A composition comprising boron at from about 1 wt % to about 17.5 wt %, potassium ferricyanide at from about 1 wt % to about 8 wt %, potassium perchlorate at from about 30 wt % to about 60 wt %, an energetic binder, and one of dibutyltin dilaurate, triphenylbismuth, magnesium carbonate, or dibutyltin diacetate.

2. The composition of claim 1, further comprising strontium nitrate.

3. The composition of claim 1, wherein the energetic binder comprises glycidyl azide polymer.

4. The composition of claim 1, further comprising calcium silicide.

5. The composition of claim 1, comprising magnesium carbonate.

6. The composition of claim 1, further comprising iron oxide.

7. The composition of claim 1, further comprising at least one additive.

8. The composition of claim 7, wherein the composition comprises 1,8-bis(dimethylamino)naphthalene and glycidyl azide polymer.

9. The composition of claim 7, wherein the composition comprises iron oxide, and further comprises nitrocellulose.

10. A countermeasure device comprising a casing and a flare composition contained in the casing, the flare composition comprising boron at from about 1 wt % to about 17.5 wt %, potassium ferricyanide at from about 1 wt % to about 8 wt %, potassium perchlorate at from about 30 wt % to about 60 wt %, an energetic binder, and one of dibutyltin dilaurate, triphenylbismuth, magnesium carbonate, or dibutyltin diacetate.

11. A method of using a countermeasure device, comprising:

deploying a countermeasure device against a heat-seeking device, the countermeasure device
comprising a casing and a flare composition contained in the casing, the flare
composition consisting of:
boron at from about 1 wt % to about 17.5 wt %,
potassium
ferricyanide at from about 1 wt % to about 8 wt %,
potassium perchlorate at from about 30 wt % to about 60 wt %,
glycidyl azide polymer,
one of dibutyltin dilaurate, triphenylbismuth, magnesium carbonate, or dibutyltin diacetate at from about 0.1 wt % to about 1 wt %; and
one or more additives selected from the group consisting of:
an isocyanate or an epoxide,
strontium nitrate,
an amine base,
a nitramine,
nitrocellulose,
ball powder,
magnesium,
aluminum, and
one or more of an alkali metal ferricyanide and a potassium salt;
and
igniting the flare composition.

12. The composition of claim 1, further comprising nitrocellulose.

13. The composition of claim 7, wherein the at least one additive comprises iron oxide.

14. The composition of claim 1, wherein the composition comprises glycidyl azide polymer.

15. The composition of claim 1, wherein the composition comprises the potassium ferricyanide at from about 1 wt % to about 4 wt %.

16. The composition of claim 1, further comprising a nitramine.

17. The composition of claim 16, wherein the composition comprises cyclo-1,3,5-trimethylene-2,4,6-trinitramine and glycidyl azide polymer, and further comprises 1,8-bis(dimethylamino)naphthalene.

18. The composition of claim 16, wherein the nitramine comprises cyclo-1,3,5-trimethylene-2,4,6-trinitramine.

19. A composition consisting of:

boron at from about 1 wt % to about 17.5 wt %;
potassium ferricyanide at from about 1 wt % to 8 wt %;
potassium perchlorate at from about 30 wt % to about 60 wt %;
glycidyl azide polymer;
one of dibutyltin dilaurate, triphenylbismuth, magnesium carbonate, or dibutyltin diacetate; and
one or more additives selected from the group consisting of:
an isocyanate or an epoxide,
strontium nitrate,
an amine base,
a nitramine,
nitrocellulose,
ball powder,
magnesium,
aluminum, and
one or more of an alkali metal ferricyanide and a potassium salt,
wherein the composition exhibits a fuel:oxidizer ratio of between about 1.4 and about 2.3.

20. A composition comprising boron, potassium ferricyanide, potassium perchlorate, glycidyl azide polymer, and 1,8-bis(dimethylamino)-naphthalene, the composition comprising the potassium ferricyanide at from 1% by weight to 8% by weight.

21. The composition of claim 7, wherein the at least one additive comprises an amine base, a curative, iron oxide, or combinations thereof.

22. The composition of claim 16, wherein the nitramine comprises cyclo-1,3,5-trimethylene-2,4,6-tri-nitramine.

23. A composition consisting of:

boron at from about 1 wt % to about 17.5 wt %;

potassium ferricyanide at from about 1 wt % to about 8 wt %;

potassium perchlorate at from about 30 wt % to about 60 wt %;

glycidyl azide polymer;

one of dibutyltin dilaurate, triphenylbismuth, magnesium carbonate, or dibutyltin diacetate at from about 0.1 wt % to about 1 wt %; and one or more additives selected from the group consisting of:

an isocyanate or an epoxide, strontium nitrate, an amine base, a nitramine, nitrocellulose, ball powder, magnesium, aluminum, and one or more of an alkali metal ferricyanide and a potassium salt.

24. A composition consisting of boron at from about 1 wt % to about 17.5 wt %, potassium ferricyanide at from about 1 wt % to about 8 wt %, potassium perchlorate at from about 30 wt % to about 60 wt %, glycidyl azide polymer, a curative, and one of dibutyltin dilaurate, triphenylbismuth, magnesium carbonate, or dibutyltin diacetate.

25. The composition of claim 1, comprising the one of dibutyltin dilaurate, triphenylbismuth, magnesium carbonate, or dibutyltin diacetate at from about 0.1 wt % to about 1 wt %.

* * * * *